US007121265B2

(12) United States Patent
Joos et al.

(10) Patent No.: US 7,121,265 B2
(45) Date of Patent: Oct. 17, 2006

(54) METHOD FOR OPERATING A FUEL SUPPLY SYSTEM FOR AN INTERNAL COMBUSTION ENGINE IN A MOTOR VEHICLE

(75) Inventors: Klaus Joos, Walheim (DE); Jens Wolber, Gerlingen (DE); Thomas Frenz, Noerdlingen (DE); Ruediger Weiss, Moetzingen (DE); Markus Amler, Leonberg-Gebersheim (DE); Karsten Hinn, Giessen (DE)

(73) Assignee: Robert Bosch GmbH, Stuttgart (DE)

( * ) Notice: Subject to any disclaimer, the term of this patent is extended or adjusted under 35 U.S.C. 154(b) by 123 days.

(21) Appl. No.: 10/490,000

(22) PCT Filed: Jul. 26, 2002

(86) PCT No.: PCT/DE02/02784

§ 371 (c)(1),
(2), (4) Date: Sep. 9, 2004

(87) PCT Pub. No.: WO03/027472

PCT Pub. Date: Apr. 3, 2003

(65) Prior Publication Data

US 2005/0005912 A1 Jan. 13, 2005

(30) Foreign Application Priority Data

Sep. 25, 2001 (DE) ..... 101 47 189

(51) Int. Cl.
*F02M 37/04* (2006.01)

(52) U.S. Cl. ..... 123/494; 123/467; 73/118.1

(58) Field of Classification Search ..... 123/494, 123/519, 518, 520, 521, 198 D, 479, 359, 123/467; 73/116, 118.1–118.2, 1.59
See application file for complete search history.

(56) References Cited

U.S. PATENT DOCUMENTS

| | | | | | |
|---|---|---|---|---|---|
| 4,928,242 | A | * | 5/1990 | Suzuki | 701/34 |
| 5,251,592 | A | * | 10/1993 | Seki et al. | 123/198 D |
| 5,590,634 | A | * | 1/1997 | Shinohara | 123/520 |
| 5,617,337 | A | * | 4/1997 | Eidler et al. | 702/104 |
| 5,808,189 | A | * | 9/1998 | Toyoda | 73/118.2 |
| 5,983,714 | A | * | 11/1999 | Izumiura et al. | 73/118.1 |
| 6,024,064 | A | * | 2/2000 | Kato et al. | 123/179.17 |
| 6,038,912 | A | * | 3/2000 | Isobe et al. | 73/1.59 |
| 6,076,504 | A | * | 6/2000 | Stavnheim et al. | 123/447 |
| 6,148,803 | A | * | 11/2000 | Majima et al. | 123/520 |
| 6,474,148 | B1 | * | 11/2002 | Takagi et al. | 73/118.1 |
| 6,754,611 | B1 | * | 6/2004 | Nagashima et al. | 702/183 |

FOREIGN PATENT DOCUMENTS

| | | |
|---|---|---|
| DE | 195 47 647 | 6/1997 |
| DE | 196 18 932 | 11/1997 |
| DE | 199 08 352 | 8/2000 |
| DE | 199 25 099 | 12/2000 |
| DE | 198 34 660 | 2/2002 |
| JP | 2001-173507 | 2/2001 |
| WO | 95/06814 | 3/1995 |
| WO | 01/2720 | 1/2001 |

* cited by examiner

*Primary Examiner*—Carl S. Miller
(74) *Attorney, Agent, or Firm*—Kenyon & Kenyon LLP

(57) ABSTRACT

A method for operating a fuel-supply system for an internal combustion engine of a motor vehicle is provided, the fuel-supply system having a fuel-storage tank, a fuel pump and a pressure sensor, the fuel pump supplying fuel from the fuel-storage tank to a pressure region, the pressure sensor being arranged in the pressure region, and the pressure sensor generating a signal representing the pressure in the pressure region.

8 Claims, 4 Drawing Sheets

METHOD FOR OPERATING A FUEL SUPPLY SYSTEM FOR AN INTERNAL COMBUSTION ENGINE IN A MOTOR VEHICLE

FIELD OF THE INVENTION

The present invention relates to a method for operating a fuel-supply system for an internal combustion engine of a motor vehicle having a fuel-storage tank, a fuel pump and a pressure sensor, in which the fuel pump supplies fuel from the fuel-storage tank to a pressure region, and the pressure sensor is arranged in the pressure region in order to generate a signal that represents the pressure in the pressure region.

BACKGROUND INFORMATION

German Published Patent Application No. 199 08 352 discloses a fuel-injection method for an internal combustion engine in which the fuel is supplied from the fuel tank into a storage chamber with the aid of an electric fuel pump and a post-connected high-pressure pump. The pressure generated in the storage chamber is measured using a pressure sensor. The system is controlled and regulated to a setpoint value of the pressure in the storage chamber. According to this reference, a fault in the fuel-supply system is detected by a plausibility check. Once a fault is detected in the fuel-supply system, a diagnostic cycle of the internal combustion engine is initiated in which diagnostic functions are activated that check the individual components of the fuel-supply system with respect to their operability. Among others, an electrical check of the high-pressure sensor is implemented by evaluating the output signals of the pressure sensor. In the process, it is ascertained whether the output signal assumes values within a permitted range, and it is checked whether the time characteristic of the output signal has a typical profile as a function of the fuel-supply system. If one of these two conditions is not satisfied, a defect or a fault of the pressure sensor is assumed. In response to the detected fault of the pressure sensor, the fault is indicated by means of a display device, and an operation for emergency conditions of the internal combustion engine is triggered at the same time. The operation under emergency conditions may be implemented such that the pressure regulation is shut off, so that the pressure in the storage chamber is set solely by the pressure-precontrol.

SUMMARY

In contrast, the present invention provides a method for operating a fuel-supply system for an internal combustion engine of a motor vehicle having a fuel-storage tank, a fuel pump, a pressure sensor and a pressure region to which the fuel pump supplies fuel. The pressure sensor is arranged in the pressure region and generates a signal representing the pressure in this region. The signal representing the pressure in the pressure region is evaluated for a diagnosis of the pressure sensor. In contrast to the related art, the method according to the present invention utilizes a pressure sensor in the low-pressure region of a fuel-supply system and may include an additional pressure sensor in the high-pressure region. The diagnosis of the pressure sensor according to the present invention, based on the signal representing the pressure in the pressure region, provides a cost-effective and reliable diagnosis possibility since no increased hardware is required and the diagnosis may be implemented in an engine-control device, which is already present anyway. Furthermore, the signal evaluation within the engine-control device also constitutes a particularly reliable option.

According to a particular embodiment, for the diagnosis, the signals representing the pressure in the pressure region may be detected at different, preselectable instants and stored in a memory. The storage of signal values results in a multitude of diagnosis options, including the possibility of analyzing averaged signal values or analyzing pressure values that correspond to specific signal values. In an advantageous manner, the analysis of the signal values stored in the memory may produce a measure for the state of the pressure sensor. Especially advantageously, preselectable instants may be stored which are a function of an operating situation of the vehicle system and/or a driving situation of the motor vehicle. Various diagnosis options result from this differentiated storage possibility of signal values at selected instants.

A first analysis option consists of checking whether the detected signal values are within a plausible signal range that is established by a maximum and a minimum threshold, a fault in the pressure sensor being assumed if the result is negative. The maximum and the minimum threshold values may be adapted to the particular fuel-supply system of a motor vehicle or to the particular pressure sensor utilized. The adapted threshold values may be stored, for example, in the memory of the engine-control device.

A second advantageous analysis option provides for a difference to be generated from two time-consecutive signal values, for a counter to be incremented if this difference is smaller than a predefinable threshold value, for the counter to be set to zero if this difference is greater than the predefinable threshold value, and for a fault of the pressure sensor to be determined if the counter has reached a preselectable threshold value. A buffer-stored signal value and the instantaneous signal value may be utilized as two time-consecutive signal values. Together with the zero setting of the counter, the instantaneous signal value is buffer-stored. This analysis option is based on the fact that there is generally a certain irregularity in the pressure signal during operation of the motor vehicle. If this irregularity is absent and a constant signal measured instead, it is highly probable that the sensor is defective. This analysis option may take place in operating points in which an irregular pressure signal is to be expected, i.e., as soon as an engine speed has been detected or during active injection. In other words, this analysis option provides that a fault of the pressure sensor is assumed if the measured pressure values change only insufficiently over a specific period of time.

A third advantageous analysis option provides for the fuel pump to be triggered according to a preselectable setpoint pressure in the pressure range, for a first setpoint pressure to be preselected and a first signal value to be stored following a response time, for a second setpoint pressure to be preselected and a second signal value to be stored following a response time, for a value of the difference to be generated from the first and second signal values, and for a fault of the pressure sensor to be determined if the value is smaller than a threshold value as a function of the difference between the first and second signal values. According to this analysis option, it is checked whether a change in the setpoint pressure in the pressure region is followed by a corresponding change in the signal representing the pressure in the pressure region. In other words, it is ascertained whether the instantaneous pressure changes in the same manner as the setpoint pressure.

Another advantageous analysis option provides for a first signal value to be stored upon a start of the motor vehicle, before the fuel pump is activated; for a second signal value to be stored following a preselectable time after activation of the fuel pump; and for a fault of the pressure sensor to be determined in those cases where the value of the difference between the first and the second signal values is smaller than a threshold value as a function of a shut-off pressure and a pressure increase. This analysis option makes it possible to check whether the pressure value in the pressure chamber rises as expected following the start-up of the fuel pump. In an advantageous manner, the check is a function of the shut-off pressure and a pressure increase. The latter is important, especially if the pressure-increase behavior of the fuel system is known.

In an advantageous manner, the pressure sensor may also be analyzed by storing a first signal value during an overrun operation of the motor vehicle, by deactivating the fuel pump, by storing a second signal value following a preselectable deactivation time, and by determining a fault of the pressure sensor if the value of the difference between the first and second signal values is smaller than a preselectable threshold value. According to this analysis option, the time duration of the overrun operation of the vehicle is used to deactivate the fuel pump and to check whether the signal value subsequently detected by the pressure sensor corresponds to expectations. The deactivation time and the additional preselectable threshold values both of this analysis method and the previous and following analysis methods may be adapted to the particular boundary conditions of the fuel-supply system, and corresponding data, for example, may be stored for this purpose in a memory of the engine control device.

An additional advantageous analysis method is very similar to the above-described method. This analysis method is distinguished in that the fuel pump is deactivated during an overrun operation of the motor vehicle, in that a first signal value is stored following a preselectable deactivation time, in that the fuel pump is deactivated, in that a second signal value is stored following a preselectable deactivation time, and in that a fault of the pressure sensor is assumed if the value of the difference between the first and second signal values is smaller than a preselectable threshold value. That is to say, in contrast to the previously described analysis method, in this case a signal value is first detected when the fuel pump is deactivated, and only afterwards a signal value is detected when the fuel pump is activated.

One exemplary embodiment, which may be implemented during an afterrun of the engine-control device following a shut-off of the vehicle, includes storing a first signal value after the internal combustion engine has been shut off, storing a second signal value following a preselectable off-duration, and determining a fault of the pressure sensor in those cases where the value of the difference from the first and second signal values is smaller than a preselectable threshold value. In this analysis method, use is made of the fact that, as a rule, the pressure in the pressure region drops after a shut-off of the motor vehicle, or after a shut-off of the internal combustion engine (and the deactivation of the fuel pump this entails).

The method according to the present invention may be implemented in a control device for an internal combustion engine of a motor vehicle. For this purpose, means for implementing the steps of the previously described method are provided.

Moreover, the method described above can be implemented in the form of a computer program having program-code means and in the form of a computer-program product having program-code means. The computer program of the present invention has program-code means for carrying out all the steps of the method according to the present invention when the program is run on a computer, e.g., a control device for an internal combustion engine of a motor vehicle. Thus, in this case the present invention may be implemented by a program stored in the control device. The computer program product of the present invention has program-code means, which are stored on a machine-readable data carrier in order to carry out the method of the present invention when the program product is run on a computer, e.g., on a control device for an internal combustion engine of a motor vehicle. Thus, in this case, the present invention may be implemented using a data carrier, so that the method of the present invention may be carried out when the program product, i.e. the data carrier, is integrated into a control device for an internal combustion engine, particularly of a motor vehicle. Specifically, an electrical storage medium, e.g. a read-only-memory (ROM), an EPROM or an electrical permanent storage such as a CD-ROM or DVD may be used as data carrier, i.e. as computer program product.

DETAILED DESCRIPTION

Figure 1:
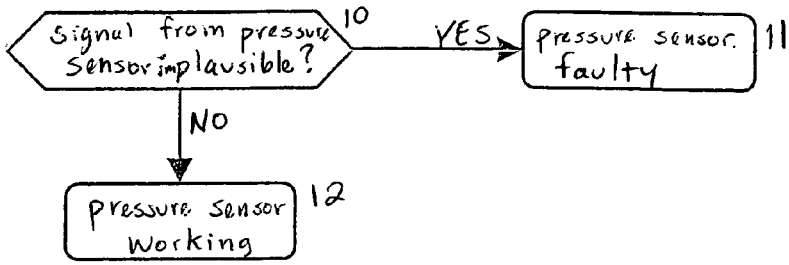
FIG. 1 shows a first diagnosis option according to the present invention.

FIG. 1 shows a first diagnosis option of the method of the present invention. According to the present invention, a pressure sensor 76 is arranged inside a fuel-supply system for an internal combustion engine of a motor vehicle. According to FIG. 7, the sensor 76 is arranged between the electric fuel pump 72, which supplies the fuel from the fuel storage tank, i.e., tank 70, and a post-connected high-pressure pump 77, the pressure sensor measuring the pressure in this intermediate pressure region 75. The pressure signal of this pressure region generated by pressure sensor 76 is analyzed for the diagnosis of pressure sensor 76. A first diagnosis option is to check the pressure value or the voltage value supplied by the sensor with respect to a plausible voltage or signal value. According to FIG. 1, it is checked in a step 10 whether the signal value, or the voltage value, is below a minimum or above a maximum threshold value. If it is determined in step 10 that the signal value is outside the range between minimum and maximum threshold value, it is concluded, in step 11, that the pressure sensor is faulty. This transition to step 11 may possibly occur after a certain delay time, thereby preventing short-term "signal outliers" from being interpreted as faults of the pressure sensor. If, however, it is determined in step 10 that the signal or voltage value of pressure sensor 76 is within a plausible signal or voltage range, it is continued with step 12 where it is decided that pressure sensor 76 is in working order. The minimum threshold value, the maximum threshold value and also the possible additional delay time may be stored in a memory 74 of an engine control device 73.

Figure 2:
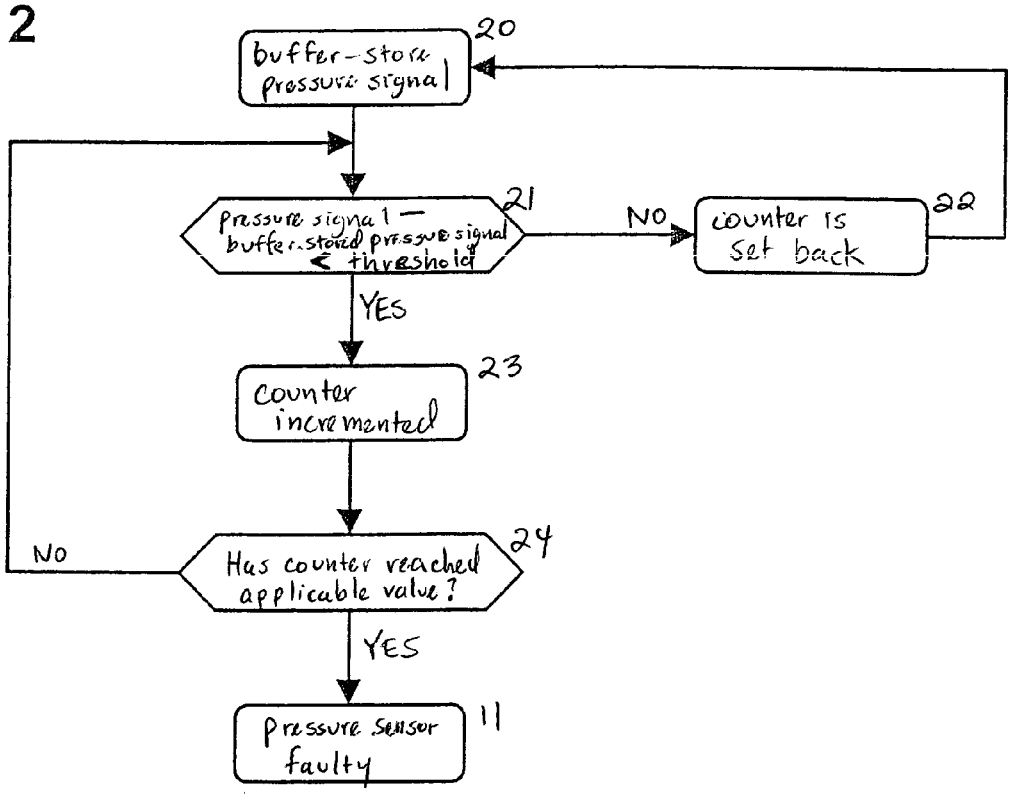
FIG. 2 shows a second diagnosis option according to the present invention.

FIG. 2 shows a second diagnosis option of the method of the present invention. Within the scope of this second diagnosis option, it is checked whether the signal or voltage profile of pressure sensor 76 has a plausible progression. For this purpose, sensor values are recorded at different, consecutive points in time and stored in a memory, for example memory 74 in control device 75. The second diagnosis option described in FIG. 2 is based on the fact that the pressure signal generally shows a certain irregularity during operation of the motor vehicle. If this irregularity is missing and if an approximately constant signal is detected instead, then it may be determined with a high degree of certainty that the pressure sensor is defective. For this purpose, the signal value, i.e., the sensor voltage, is compared to previously buffer-stored values. If the amount of the difference between these two values is smaller than a preselectable threshold value, this may indicate a possible fault. In order to verify this over a certain period of time, a counter is counted up in those cases where the difference value is smaller than the threshold value. If this procedure is carried out over a certain number of consecutive steps, that is, if the detected sensor signal does not change to any significant extent compared to the previously buffer-stored values, a signal fault is detected. On the other hand, if a sensor value is detected that has changed by more than the threshold value compared to the previous signal value, the counter is set back and an intact pressure sensor 76 is determined. The diagnosis option may take place in operating points in which an unsteady signal of the pressure sensor is to be expected, e.g., as soon as an engine speed has been detected or during active injection.

According to the specific exemplary embodiment illustrated in FIG. 2, a signal value of pressure sensor 76 is buffer-stored in a first step 20. In step 21, it is ascertained whether the amount of the difference between the instantaneous sensor-signal value and the previously buffer-stored sensor-signal value is smaller than a preselectable threshold value. If this is not the case, that is to say, if the sensor signal displays the expected irregularity, in step 22, a counter is set back. Following step 22, the method returns to step 20 again. However, if it is determined in step 21 that the value is smaller than the preselectable threshold value, in step 23 a counter is incremented. In step 24, which follows step 23, it is queried whether the counter has reached an applicable threshold value. If this is not the case, the method returns to step 21 from step 24. If, on the other hand, the counter has reached an applicable threshold value in step 24, it returns to step 11 in which a defective pressure sensor is detected. In practical terms, if the counter has reached an applicable threshold value, this means that the signal value of the pressure sensor has changed only insufficiently over a certain period of time, which may be defined by the amount of the applicable threshold value.

Figure 3:
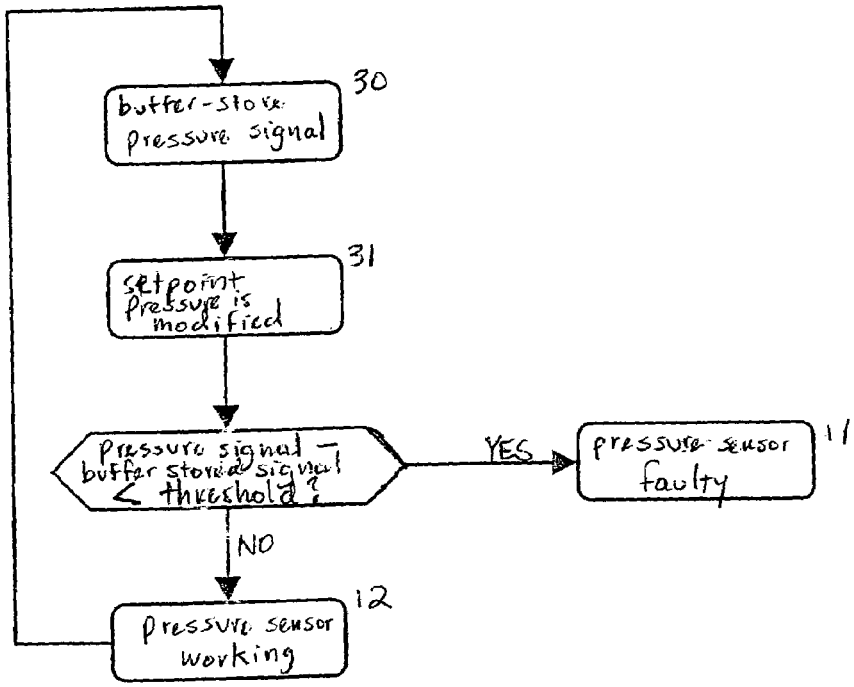
FIG. 3 shows a third diagnosis option according to the present invention.

FIG. 3 shows a third diagnosis option of the method of the present invention. This third diagnosis option makes use of the possibility, offered by demand-regulated fuel-supply systems, of varying the system pressure by inputting a setpoint pressure. In order to diagnose the pressure sensor, an instantaneous sensor value is buffer-stored. Subsequently, a setpoint pressure is preselected that differs from the instantaneous pressure (which is equivalent to changing a guide variable) and a specific applicable time is observed until the instantaneous pressure has adjusted to the setpoint pressure. Then, another sensor signal value is detected and it is ascertained whether the amount of the difference is greater than, or equal to, an applicable threshold value as a function of the change in the guide variable. If this is the case, the pressure sensor is working correctly; however, if no essential pressure differential is detectable, that is to say, if the amount of the difference is smaller than an applicable threshold value as a function of the change in the guide variable, a defective pressure sensor is determined.

In FIG. 3, an instantaneous pressure-sensor signal value, i.e., a pressure-sensor voltage, is buffer-stored in a first step 30. In following step 31, the setpoint pressure is modified and an applicable time observed until this pressure value has come about. In order to achieve different pressure values in the low-pressure region, fuel pump 72, for example, may be triggered in a voltage- and speed-regulating manner via engine-control device 73, using a signal line. Within certain limits, this voltage- or rpm-control allows a desired adjustment of the pressure in first pressure region 75. If a new pressure value has come about according to step 31, it is detected by pressure sensor 76 in step 32. The value of the difference between the first and the second detected signal values is generated and this value is compared to a threshold value. The threshold value is a function of the difference between the first and second setpoint pressures in first pressure region 75. If it turns out in step 32 that the value of the difference between the first and second signal values is smaller than the threshold value, a defective pressure sensor is determined and the method returns to step 11. If, however, it is determined in step 32 that the above-mentioned condition has not been satisfied, the method returns to step 12 in which a satisfactory state of the pressure sensor is determined. Subsequent to step 12, the method according to the present invention begins anew in step 30.

Figure 4:
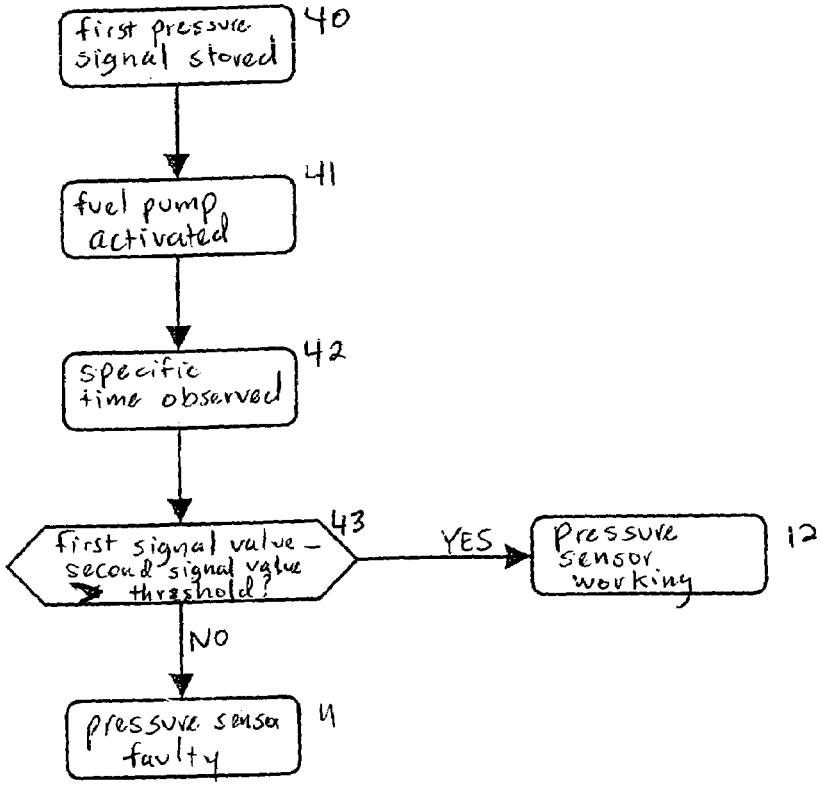
FIG. 4 shows a fourth diagnosis option according to the present invention.

FIG. 4 shows a fourth diagnosis option according to the present invention, which is based on the pressure differential between deactivated and activated fuel pump 72. Before fuel pump 72 is activated in the starting state of the internal combustion engine, a fuel-pressure value detected by pressure sensor 76 is stored. Following a certain applicable time after activation of fuel pump 72, another pressure value in pressure region 75 is detected and stored. Subsequently, the amount difference is generated from the previously stored two pressure values. If the value of the difference between the first and second pressure values is smaller than a threshold value as a function of a shut-off pressure and a pressure increase, a fault in pressure sensor 76 is determined.

In FIG. 4, the method according to the present invention is represented as follows: In a first step 40, a first signal value is stored before fuel pump 71 is activated upon start-up of the motor vehicle. In the following step 41, fuel pump 72 is activated. In step 42, which follows step 41, a specific applicable time is observed until the pressure in pressure region 75 has adjusted to the pressure value preselected by activated fuel pump 72. In step 43, the value of the difference between the first signal value according to step 40 and a time-instantaneous, second signal value is generated. The difference between the first and second signal values is compared to a threshold value. The applicable threshold value is a function of the shut-off pressure and the pressure increase. The corresponding data for the applicable threshold value may be stored in a characteristics map of engine-control device 73. If it is determined in step 43 that the difference between the first and second signal values is greater than the threshold value, it is decided in subsequent step 12 that the pressure sensor is in working order. If the value of the difference is smaller than, or equal to, the threshold value, or if the value of the difference is not greater than the threshold value, a defective pressure sensor is determined in subsequent step 11.

Figure 5A:
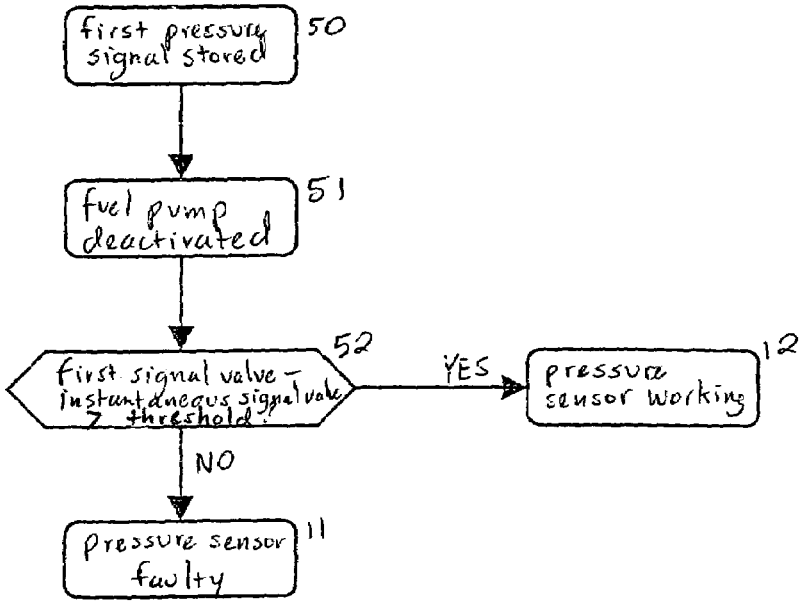
FIGS. 5*a* and 5*b* show a fifth diagnosis option in two different embodiments of the present invention.
Figure 5B:
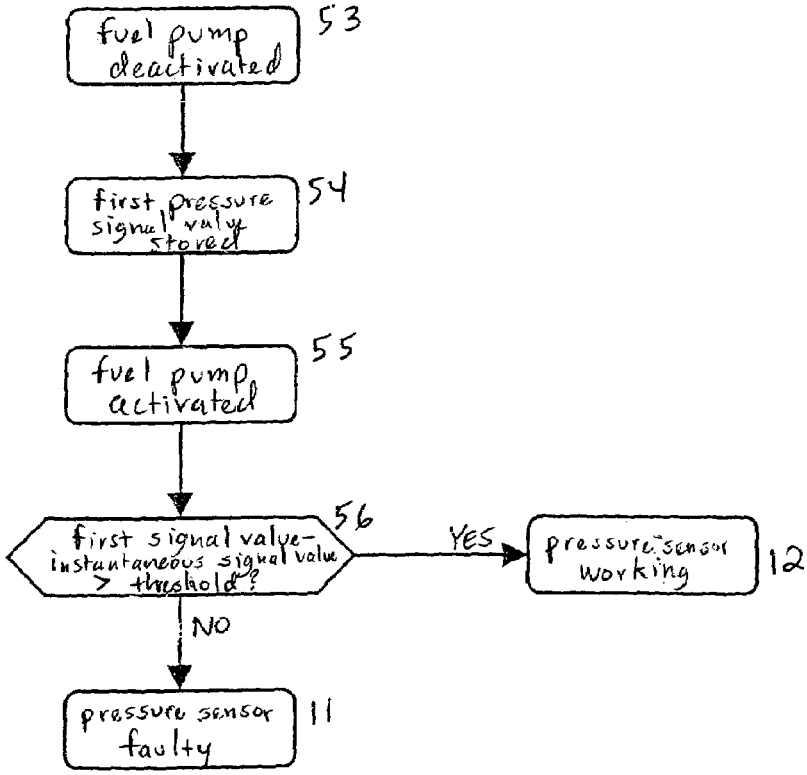

A fifth diagnosis option according to the present invention is shown by the two FIGS. 5*a* and 5*b*, which utilize the possibility of briefly deactivating fuel pump 72 during an overrun operation of the motor vehicle and take advantage of the pressure-differential values in pressure region 75 resulting therefrom. According to FIG. 5*a*, a first signal value representing the pressure in pressure region 75 is stored in a step 50 during an overrun operation of the motor vehicle. This first pressure measurement according to step 50 thus takes place during the overrun operation, in a state in which fuel pump 72 is activated. In the following step 51, fuel pump 72 is briefly deactivated, and a preselectable time following the activation of fuel pump 72 is observed, so that the newly resulting pressure level may adjust in pressure region 75. In step 52, the value of the difference is generated from the first stored signal value and the instantaneous signal value. This value of the difference is subsequently compared to a selectable threshold value. If it turns out in the process that the amount value of the difference is greater than a preselectable threshold value, it is concluded, in step 12, that the pressure sensor is functioning normally. However, if the value of the difference is not greater than the preselectable threshold value, a defective pressure sensor is determined in step 11. After implementation of this diagnosis method according to the present invention, fuel pump 72 may be reactivated in order to provide the required fuel pressure in pressure region 75 during a possible restarting following the overrun operation.

FIG. 5*b* describes a diagnosis option according to the present invention, which is based on the same physical principle as the option illustrated in FIG. 5*a*. In this case, electric fuel pump 72 is first deactivated in step 53 during an overrun operation of the motor vehicle and a preselectable deactivation time is observed. Following this deactivation time, a first pressure value of pressure sensor 76 is stored in step 54. In the following step 55, fuel pump 72 is activated again and a preselectable activation time observed. In subsequent step 56, the then instantaneous pressure-sensor value is detected and the value of the difference generated from the first and the second pressure-sensor signal values. If this value of the difference is greater than a preselectable threshold value, it is switched to step 12 in which a functioning pressure sensor is determined. If this is not the case, a defective pressure sensor is determined in step 11. The deactivation time or the activation time utilized within the scope of the method shown in FIGS. 5*a* and 5*b* allows the fuel-pressure region to arrive at an adjusted state.

Figure 6:
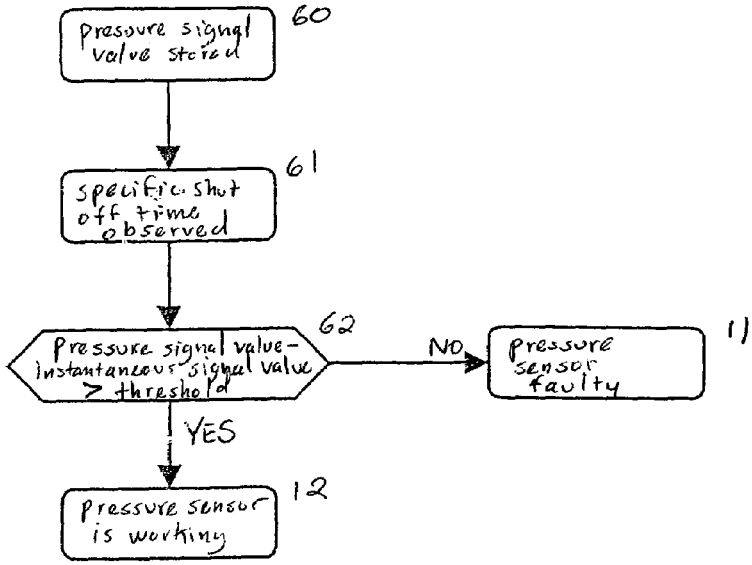
FIG. 6 shows a sixth diagnosis option according to the present invention.

FIG. 6 shows a sixth diagnosis option of the method of the present invention. This diagnosis option is based on a pressure measurement during the afterrunning of the control device following the shut-off of the motor vehicle's engine. In the process, a signal value of the pressure sensor is stored in a step 60, shortly after the engine of the motor vehicle has been shut off, during afterrunning of the control device. In step 61, a specific applicable shut-off time is observed. After this applicable shut-off time has elapsed, an instantaneous signal value of the pressure sensor is recorded in step 62 and the value of the difference is generated from the first and second signal values. If in doing so a value of the difference from the first and second signal values is determined that is greater than an applicable threshold value, it is decided that the pressure sensor is functioning normally in step 12. If this is not the case, a defective pressure sensor is determined in step 11.

In the described diagnosis options according to FIGS. 1, 2, 3, 4, 5*a*, 5*b* and 6, it is possible that step 11, in which a defective pressure sensor is determined, is followed by a corresponding display in the visual field of the driver of the motor vehicle, or by additional measures. Among these additional measures are an entry in a fault memory of a memory 74 of a control device 73, or an operation under emergency conditions of the motor vehicle or the internal combustion engine, for example. Within the framework of operation under emergency conditions, it is possible to move from a pressure regulation, which requires the pressure sensor, to a pure pressure control according to characteristic maps stored in control device 73.

The threshold values described in the figures are applicable without exception. This means that the threshold values may be adjusted to the particular application, or to the particular vehicle type as indicated by the manufacturer of the motor vehicle. To this end, the threshold values specified by the manufacturer are stored in a memory 74 of engine-control device 73. This takes place during an application at the manufacturer of the engine-control device prior to delivery to the motor vehicle manufacturer.

Moreover, it is within the scope of the method of the present invention to use an averaged sensor-signal value instead of detecting a single value, so as to further increase the accuracy and reliability of the method according to the present invention. In the same manner, a corresponding pressure value may be gathered from a signal value/pressure value characteristic map in accordance with the sensor-signal value determined by the pressure sensor. To implement the method according to the present invention, it is also possible to utilize the direct physical voltage values of the pressure sensor. In the latter case, the applicable threshold values must be adapted accordingly.

Figure 7:
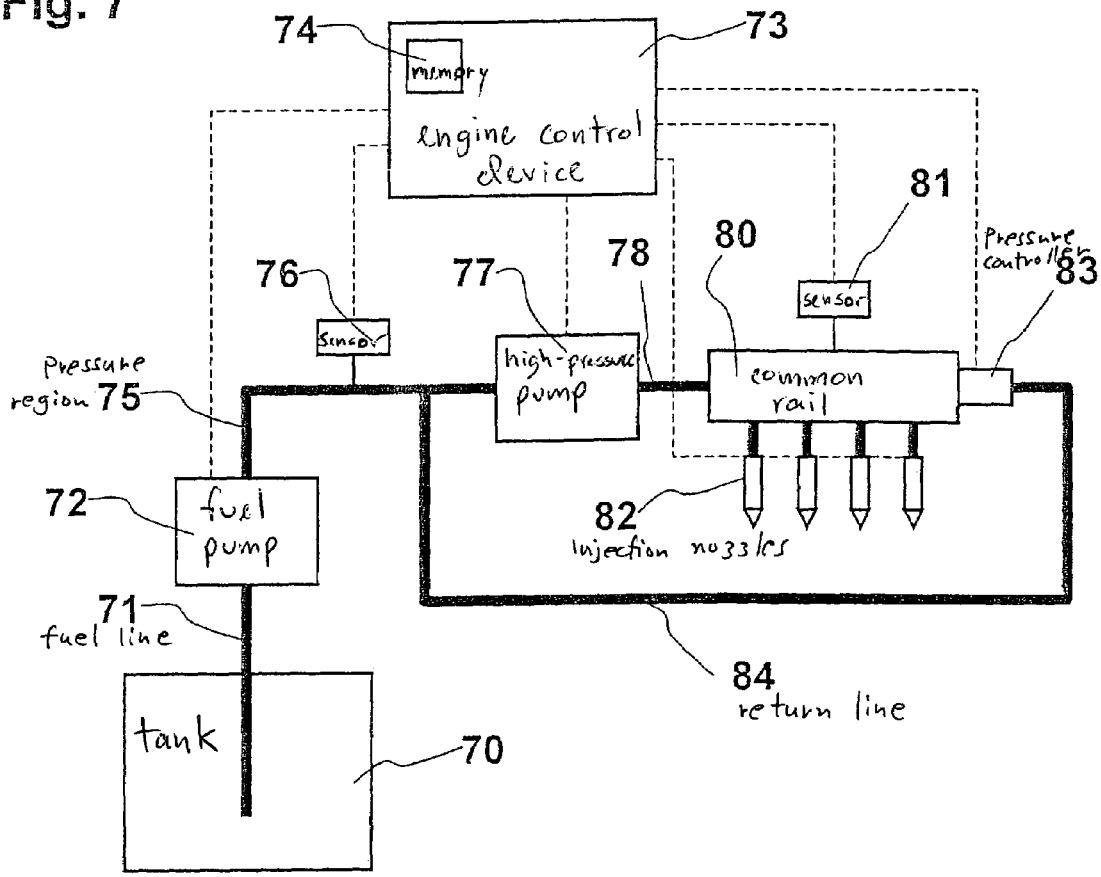
FIG. 7 shows an exemplary embodiment of a fuel supply system according to the present invention.

FIG. 7 shows a fuel-supply system according to the present invention for an internal combustion engine of a motor vehicle. A fuel pump 72 conveys the fuel coming from fuel-storage tank 70 to one of pressure regions 75, using a fuel line 71. To this end, fuel pump 72 is triggered by an engine control device 73 having a memory 74. In the representation according to FIG. 7, this triggering is indicated by a dashed line between engine-control device 73 and fuel pump 72. Of course, the method according to the present invention can be implemented with either unregulated or uncontrolled fuel pumps. The pressure in pressure region 75 is determined by means of a pressure sensor 76 arranged in pressure region 75. The data from pressure sensor 76, or the sensor-signal values of pressure sensor 76, are transmitted to engine-control device 73. This transmission is indicated by a dashed line between pressure sensor 76 and engine-control device 73. Starting from pressure region 75, a high-pressure pump 77 conducts the fuel to a high-pressure region 78 that discharges into a so-called common rail 80. In the event that a regulatable or controllable high-pressure pump 77 is used, the corresponding trigger signals are indicated by a dashed line starting from engine-control device 73 and leading to high-pressure pump 77. The pressure in common rail 80 is detected by a high-pressure sensor 81, which transmits the measured pressure signals—likewise indicated by a dashed line—to engine-control device 73. From common rail 80, the fuel is injected via fuel injectors 82, so-called injectors, directly into the combustion chambers (not shown in FIG. 7) of the internal combustion engine. The triggering of the injectors or injection nozzles 82 is again carried out by engine-control device 73. This triggering is indicated by a dashed line starting from engine-control device 73 to injectors 82. Moreover, an arrangement 83, which influences the pressure in common rail 80, is arranged at common rail 80. In the simplest case, this is a high-pressure controller 83, which discharges fuel into a return line 84 if the pressure in common rail 80 is too high. The fuel returns to pressure region 75 by way of return line 84. If a pressure-controlling arrangement 83 is provided that can be controlled or regulated, such as a pressure-modulation valve, the trigger line required for this purpose is indicated by a dashed line starting from engine-control device 73.

Engine-control device 73 with the program data and characteristic maps stored in memory 74 as well as applicable threshold values and additional data, carries out the method of the present invention as previously described in connection with FIGS. 1 through 6, the pressure-signal values determined by pressure sensor 76 or the signals from pressure sensor 76 representing the pressure in pressure region 75 being evaluated in engine-control device 73. On the basis of these evaluated signals, a correct functioning of the pressure sensor may be concluded.

As shown in FIG. 7, the fuel system is made up of a fuel pump 72 and a high-pressure pump 77, as well as injectors for a subsequent direct injection into the combustion chambers of an internal combustion engine. Of course, the method according to the present invention may also be used in a device that implements a low-pressure injection, that is, a device in which no high-pressure pump 77, no common rail 80 and no direct injection are provided. In this case, the fuel may be injected from pressure region 75 into an intake manifold, using fuel injectors. In this case, too, a correct operation of pressure sensor 76 may be determined by means of the diagnosis according to the present invention.

What is claimed is:

1. A method for operating a fuel-supply system for an internal combustion engine, the fuel-supply system including a fuel-storage tank, a fuel pump for supplying fuel from the fuel-storage tank to a pressure region, and a pressure sensor, the pressure sensor being arranged in the pressure region and being configured to generate a signal representing a pressure in the pressure region, the method comprising:

detecting signals from the pressure sensor at least two different preselected time instants, wherein the preselected time instants are determined as a function of at least one of a state of the fuel-supply system and a driving situation of the motor vehicle;

storing the signals detected at different preselected time instants in a memory; and determining a fault of the pressure sensor if a value of a difference between a first signal value and a second signal value is smaller than a preselected threshold value;

wherein the fuel pump is triggered according to preselected setpoint pressures in the pressure region, a first setpoint pressure being preselected and the first signal value being detected following a first response time, and a second setpoint pressure being preselected and the second signal value being detected following a second response time.

2. The method as recited in claim 1, wherein:

the first signal value is detected upon a start-up of the motor vehicle before the fuel pump is activated;

the second signal value is detected following a preselected time after activation of the fuel pump; and the threshold value is determined as a function of a shut-off pressure and a pressure increase.

3. The method as recited in claim 1, wherein:

the first signal value is detected during an overrun operation of the motor vehicle; and the second signal value is detected after a preselected deactivation time following a deactivation of the fuel pump.

4. The method as recited in claim 1, wherein:

the first signal value is detected after a preselected deactivation time following deactivation of the fuel pump during an overrun operation of the motor vehicle; and the second signal value is detected after a preselected activation time following activation of the fuel pump.

5. The method as recited in claim 1, wherein:

the first signal value is detected following a shut-off of the internal combustion engine; and the second signal value is detected following a preselected shut-off time.

6. A control device for an internal combustion engine of a motor vehicle, the motor vehicle having a fuel-storage tank and a fuel pump supplying fuel from the fuel-storage tank to a pressure region, comprising;

a pressure sensor arranged in the pressure region and configured to generate signals representing the pressure in the pressure region at least two different preselected time instants as a function of at least one of a state of the fuel-supply system and a driving situation of the motor vehicle; and an electronic control unit configured to:

receive the signals detected at the pressure sensor at the different preselected time instants;

store the signals detected at the different preselected time instants in a memory; and determine a fault of the pressure sensor if a value of a difference between the first signal value and the second signal value is smaller than a preselected threshold value;

wherein the fuel pump is triggered according to preselected setpoint pressures in the pressure region, a first setpoint pressure being preselected and the first signal value being detected following a first response time, and a second setpoint pressure being preselected and the second signal value being detected following a second response time.

7. A computer-readable storage medium storing a computer program having program codes executable on a processor of an electronic control unit of a motor vehicle, the program performing, when executed by the processor, control of:

receiving signals detected at a pressure sensor, the pressure sensor arranged in a pressure region of a fuel-supply line and configured to generate signals representing the pressure in the pressure region at least two different preselected time instants;

storing the signals detected at the two different preselected time instants in a memory; and determining a fault of the pressure sensor if a value of a difference between a first signal value and a second signal value is smaller than a preselected threshold value;

wherein a fuel pump for supplying fuel from a fuel-storage tank to the pressure region is triggered according to preselected setpoint pressures in the pressure region, a first setpoint pressure being preselected and the first signal value being detected following a first response time, and a second setpoint pressure being preselected and the second signal value being detected following a second response time.

8. A fuel-supply system for an internal combustion engine of a motor vehicle, comprising:

a fuel-storage tank;

a fuel pump for supplying fuel from the fuel-storage tank to a pressure region;

a pressure sensor arranged in the pressure region configured to generate signals which represent the pressure in the pressure region; and a processing unit configured to evaluate the signals representing the pressure in the pressure region for a diagnosis of the pressure sensor, the processing unit further being configured to:

receive signals representing the pressure in the pressure region detected at least two different preselected time instants, the preselected time instants being determined as a function of at least one of a state of the fuel-supply system and a driving situation of the motor vehicle;

store the signals in a memory; and determine a fault of the pressure sensor if a difference between the values of a first signal and a second signal is smaller than a preselected threshold value;

wherein the fuel pump is triggered according to preselected setpoint pressures in the pressure region, a first setpoint pressure being preselected and the first signal value being detected following a first response time, and a second setpoint pressure being preselected and the second signal value being detected following a second response time.

* * * * *